United States Patent [19]

Corcoran et al.

[11] Patent Number: 4,507,012

[45] Date of Patent: Mar. 26, 1985

[54] APPARATUS AND METHOD FOR FILLING TRENCHES IN PAVED SURFACES

[76] Inventors: John J. Corcoran, 5329 Via Corona, Los Angeles, Calif. 90022; John P. Fraijo, 16154 Calle De Paseo, Irwindale, Calif. 91706

[21] Appl. No.: 367,133

[22] Filed: Apr. 9, 1982

[51] Int. Cl.[3] ..... E01C 19/12

[52] U.S. Cl. ..... 404/72; 404/110

[58] Field of Search ..... 404/72, 110, 98, 101, 404/108, 107, 127, 104, 105, 75, 78

[56] References Cited

U.S. PATENT DOCUMENTS

| | | | |
|---|---|---|---|
| 1,707,391 | 4/1929 | Fox | 404/75 |
| 1,858,645 | 5/1932 | Smoot | 404/110 X |
| 2,104,086 | 1/1938 | Lines | 404/107 X |
| 2,116,503 | 5/1938 | Arndt | 404/104 |
| 2,255,345 | 9/1941 | Baily | 404/72 |
| 2,539,063 | 1/1951 | Ekenstam | 404/98 X |
| 2,839,975 | 6/1958 | Robinson | 404/110 |
| 2,962,947 | 12/1960 | MacDonald | 404/108 |
| 3,020,813 | 2/1962 | Gross | 404/107 |
| 3,130,652 | 4/1964 | Newton, Sr. et al. | 404/107 |
| 3,182,460 | 5/1965 | Durston et al. | 404/104 X |
| 3,331,209 | 7/1967 | Sensibar et al. | 404/72 X |
| 3,566,760 | 3/1971 | Lafleur | 404/98 |
| 4,319,859 | 3/1982 | Wise | 404/98 X |

FOREIGN PATENT DOCUMENTS

| | | | |
|---|---|---|---|
| 336362 | 4/1920 | Fed. Rep. of Germany | 404/107 |
| 1058510 | 2/1967 | United Kingdom | 404/75 |

*Primary Examiner*—James A. Leppink
*Assistant Examiner*—Beverly E. Hjorth
*Attorney, Agent, or Firm*—Nilsson, Robbins, Dalgarn, Berliner, Carson & Wurst

[57] ABSTRACT

Apparatus and method for filling trenches in paved surfaces involve a primary structure movable along a trench to conduct a substantially granular paving material into the trench, and provision for vibrating the paving material as it is conducted into the trench. In a preferred embodiment the primary structure includes a rearwardly sloped surface which engages the paving material as the container moves, urging the paving material downwardly into the trench.

14 Claims, 7 Drawing Figures

APPARATUS AND METHOD FOR FILLING TRENCHES IN PAVED SURFACES

BACKGROUND OF THE INVENTION

The present invention relates to the paving art and, more particularly, to an apparatus and method for filling trenches in paved surfaces.

It is often necessary to disturb a portion of a roadway or other paved surface for the purpose of laying or repairing conduits therein. For example, commercial television cables are commonly installed in existing neighborhoods by burying them beneath the streets of the neighborhoods. Trenches are dug in the streets for this purpose. The paved surface at the location of each trench must later be patched to a condition equal to or better than the condition of the surface before the trench was dug.

In practice, it is difficult to satisfactorily patch paved surfaces in which trenches have been dug. Using conventional techniques, a trench is backfilled with a concrete slurry material within a few inches of the paved surface. After the slurry hardens, asphalt is shoveled into the trench to form a mound higher than the paved surface. A roller is then used to compact the mound, hopefully yielding a smooth patch coinciding with the paved surface. However, the sticky nature and poor flow characteristics of asphalt make it difficult to obtain a uniform density within the trench before compacting. Even if great care is taken to form a uniform mound of asphalt before the rolling process, the material within the trench will have localized portions of low and high density, respectively. This condition persists after the mound is rolled to the level of the paved surface, allowing portions of the patch to settle over time and produce a grossly uneven surface. The process of shoveling asphalt into the trench is also very time consuming. In fact, crews engaged in the process have generally been able to cover no more than one mile of trench per day.

Another technique for compacting asphalt in the patching of paved surfaces is to repeatedly strike the asphalt with a flat lower surface of a portable vibratory unit. This technique is commonly used at locations which are inaccessible to conventional heavy rollers.

Therefore, in many applications it is desirable to provide an apparatus for efficiently distributing and compacting a substantially granular paving material within a trench in a paved surface.

SUMMARY OF THE INVENTION

The present invention comprises an apparatus and method for filling trenches in paved surfaces. The apparatus includes: a primary structure movable along a trench in a paved surface, including means for receiving a substantially granular paving material and means for conducting the paving material into the trench as the primary structure moves; and means for vibrating the paving material as it is conducted into the trench.

In a preferred embodiment, the vibrating means is coupled to the primary structure to vibrate the paving material therein, and the conducting means incorporates a rearwardly sloping surface portion which engages the paving material above the trench to urge it downwardly in a troweling relationship. The sloping surface portion preferably terminates at a location higher than the paved surface to form a rearward opening through which the paving material is forced as the primary structure moves.

The apparatus and method of the present invention permit a substantially granular paving material to be conducted into a trench in a precompacted and uniformly distributed condition. As long as sufficient paving material is supplied to the apparatus, the trench beneath the apparatus and the flow path within it will remain filled. The vibratory unit facilitates a smooth flow of paving material through the apparatus as it causes the material to settle therein. An even distribution of paving material is thus produced within the apparatus by eliminating many of the air spaces which would otherwise exist. At the same time, the rearwardly sloping surface portion and converging side walls of the apparatus exert a compacting force on the asphalt. The side walls compact the material laterally as it directs the material to a location over the trench, and the sloping surface portion exerts a downward force in the manner of a trowel. As the material is compacted, a predefined quantity is forced from an opening at the rear of the sloped surface in a process similar to extrusion. The "extruded" material extends above the level of the paved surface directly over the trench, permitting further compaction of the material by a conventional roller mechanism. The material may extend approximately one inch above the paved surface, depending upon the degree of additional compaction required.

The filling and rolling process of the present invention produces almost complete compaction of the paving material within the trench. When asphalt is used as the paving material, the patched area presents a smooth and long lasting surface which is not subject to localized settling. The method of the present invention can also be performed at a much greater rate than the manual process heretofore used, permitting a crew to patch five or more miles of trench in one day with excellent results.

The apparatus of the present invention is preferably mounted on skids to slide along the trench being filled, with the skids contacting the paving material on opposite sides of the trench. In this embodiment, a guide is preferably provided at the front of the apparatus to engage the inner side walls of the trench. The guide may be adjusted in width to center the apparatus along trenches of different size.

The side walls may be adjustable to vary the width of the extrusion opening at the rear of the apparatus to coincide with the trench. In addition, a rear gate may be provided for varying the height of the material above the paved surface. These adjustments permit adaptation to a variety of trench dimensions and conditions.

BRIEF DESCRIPTION OF THE DRAWINGS

The above and other features of the present invention may be more fully understood from the following detailed description, taken together with the accompanying drawings, wherein similar reference characters refer to similar elements throughout and in which.

DESCRIPTION OF THE PREFERRED EMBODIMENTS

Figure 1:
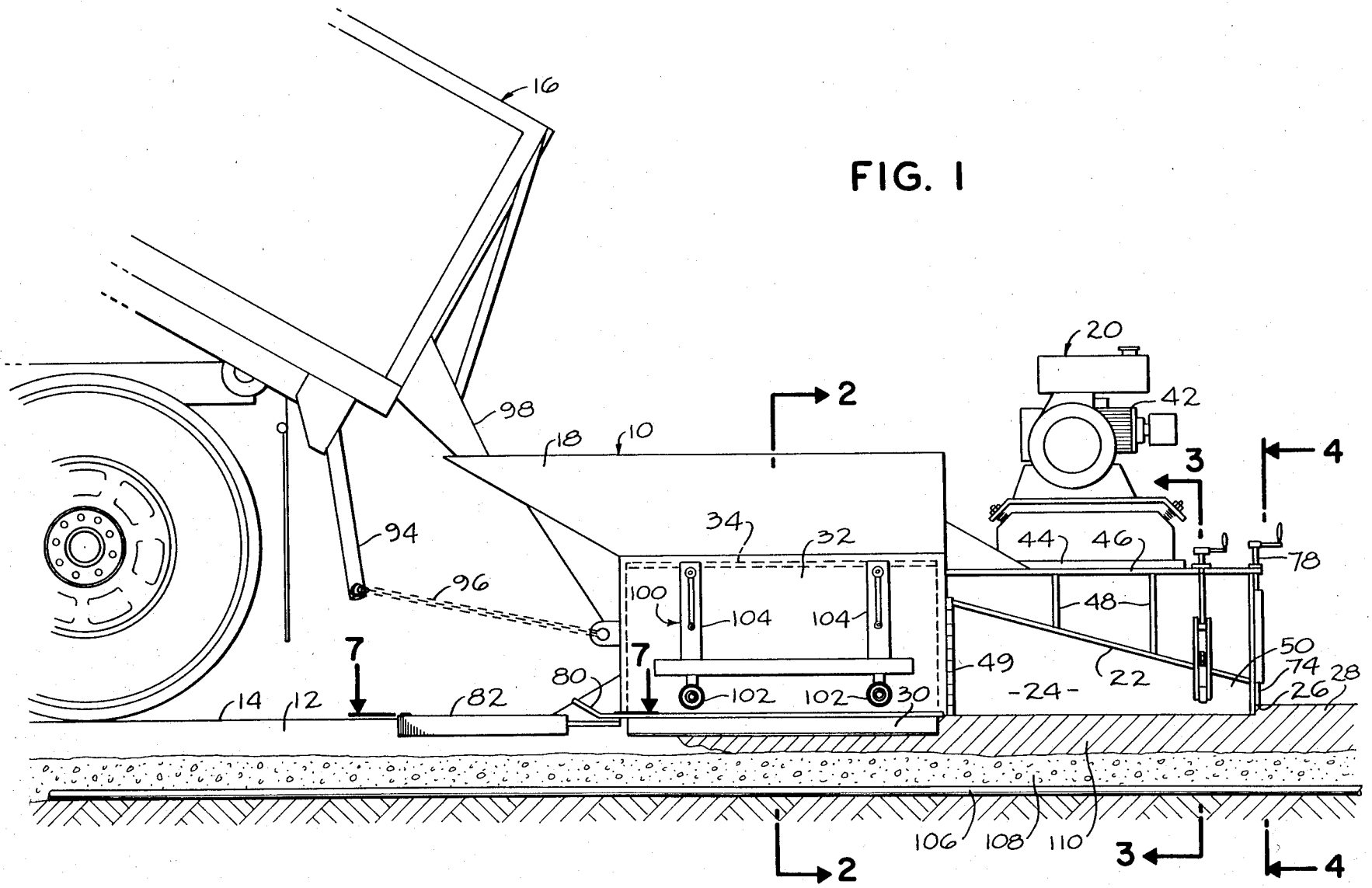
FIG. 1 is a somewhat diagrammatic side elevational view of the apparatus of the present invention being towed behind a truck.

Referring now to the drawings, there is shown an apparatus 10 constructed in accordance with the present invention. The apparatus 10 is pulled along a trench 12 of a paved surface 14 by a truck 16. Asphalt or other substantially granular paving material is passed from the truck to a hopper 18 of the apparatus, from which it is conducted to the trench 12. The flow of asphalt through the apparatus 10 is facilitated by the vibratory unit 20 which also serves to compact the asphalt material. Additional compaction is achieved by a sloping surface portion 22 and a pair of converging side walls 24 which urge the asphalt toward the trench. Some of the asphalt material is forced out a rear opening 26 of the apparatus 10, yielding a portion 28 above the paved surface 14 at the location of the trench 12. The asphalt applied to the area of the trench is thus uniformly distributed therealong and is largely precompacted. The job may be completed by passing a conventional pavement roller over the trench to force the portion 28 therein. The rolling process essentially fully compacts the asphalt material, yielding a smooth and long-lasting patch.

Figure 2:
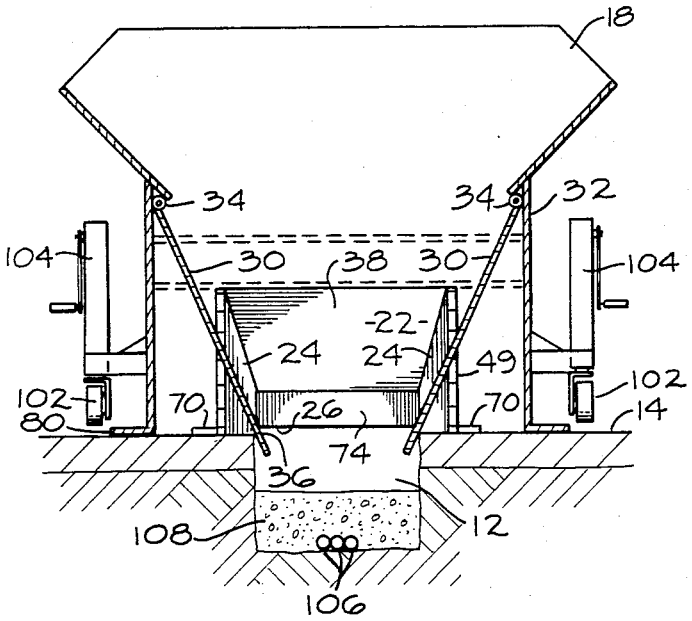
FIG. 2 is a vertical sectional view taken along the line 2—2 of FIG. 1.
Figure 6:
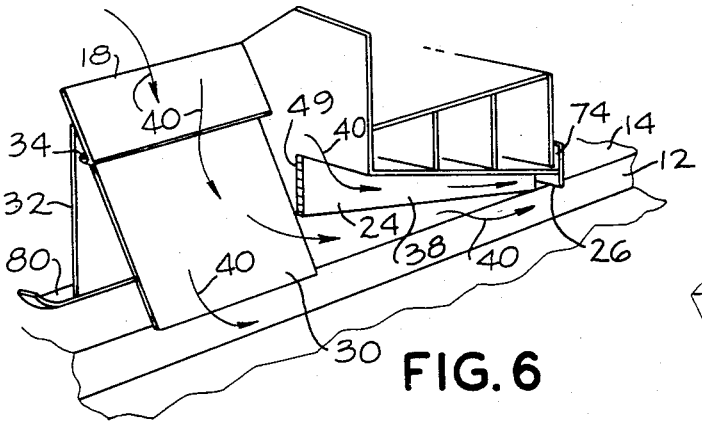
FIG. 6 is a schematic view of a portion of the apparatus of FIG. 1, showing the flow of paving material through the apparatus and into the trench.

With particular reference to FIGS. 2 and 6, the asphalt or other paving material entering the hopper 18 is initially guided to the area of the trench by a pair of doors 30 which are hinged to a lower housing 32 of the hopper about a pair of spaced axes 34. The lower end portions of the doors 30 engage opposite edges 36 of the trench to guide the asphalt into the trench. Sufficient asphalt is introduced to the hopper 18 to fill a passage 38 formed by the sloping surface portion 22 and the side walls 24, as well as the portion of the trench 12 beneath the apparatus. As the apparatus is moved along the trench, the asphalt material flows downwardly between the doors 30 and rearwardly through the passage 38 in the manner indicated by the arrows 40 of FIG. 6. The converging side walls 24 urge asphalt material inwardly toward the trench 12 while the sloping surface 22 urges it downwardly into the trench. The effect of the side walls 24 and the sloping surface 22 is best described as a compressive troweling action.

As the apparatus 10 is advanced along the trench, a portion of the compressed paving material is forced outwardly through the rear opening to form the portion 28 of uniform cross-section which extends above the level of the paved surface. Although this process is not identical to extrusion processes in which materials are forced through stationary dies, it is similar in many respects to such processes and therefore is described herein as an "extrusion" of the paving material.

The flow of asphalt or other paving material through the apparatus 10 and into the trench is facilitated by the vibratory unit 20 which directly vibrates the apparatus. Vibration causes the paving material to settle and eliminates voids or air spaces which would otherwise exist therein. In addition, the unit 20 imparts substantially vertical vibrational forces to the sloping surface portion 12, enhancing compaction of the paving material by patting it downwardly into the trench. Asphalt applied in this way is much denser than asphalt shoveled in place and the density is substantially constant along the trench. Final compaction is achieved uniformly by rolling the portion 28 to the height of the paved surface 14. The density of the patch is then typically between 95 and 97 percent of the maximum density achievable with asphalt.

Although the unit 20 can take any form suitable for vibrating the apparatus 10, it is preferably a commercial vibratory unit of the type used to compact gravel and other paving materials in inaccessible areas. A suitable unit, sold by Wacker Corporation as Model VPG160K, is designed to directly contact a paved surface for compaction. It includes a gasoline engine 42 and an eccentric vibrating mechanism (not shown) which are resiliently mounted to a base 44. The unit produces vibrational forces within a substantially vertical plane, causing the base 44 to move vertically. In the apparatus 10, the base 44 is fixed to a top plate 46 which overlies the sloping surface portion. The top plate 46 and the surface portion 22 are connected by a pair of vertical plates 48 for rigidity.

Figure 3:
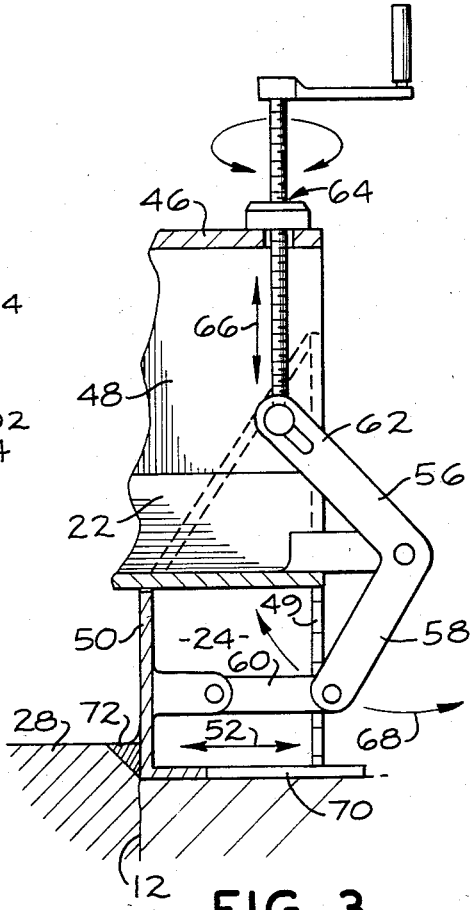
FIG. 3 is a fragmentary vertical sectional view taken along the line 3—3 of FIG. 1.
Figure 4:
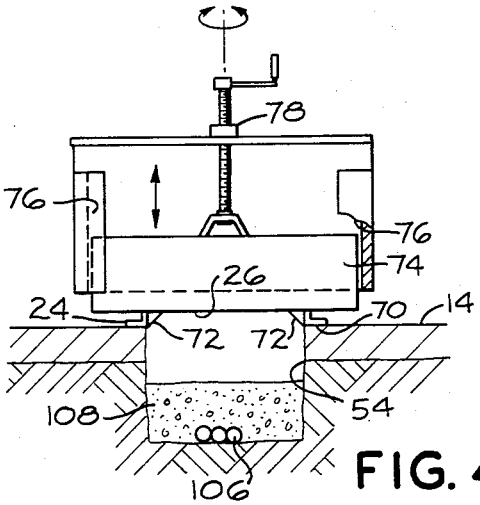
FIG. 4 is a sectional view taken along the line 4—4 of FIG. 1.

The structure of the converging side walls 24 is shown most clearly in FIGS. 3 and 4, wherein the side walls pivot relative to the lower housing 32 about a pair of vertical hinges 49. Remote ends 50 of the side walls are adjusted laterally, as indicated at 52 in FIG. 3, to coincide with the walls 54 of the trench. The positioning of the ends 50 is controlled by a pair of bell cranks 56 which are pivotally mounted to opposite sides of the surface portion 22. Lower arms 58 of the bell cranks are connected to the side walls by suitable connecting links 60, and upper arms 62 are controlled by a pair of screw mechanisms 64. Advancement of one of the screw mechanisms pivots the corresponding bell crank, as indicated at 68, producing the lateral swinging movement 52. Suitable clearance is provided between the side walls and the sloping surface portion 22 to permit the walls to swing without mechanical interference. The granular nature of asphalt and other suitable paving materials prevents appreciable leakage of paving material between the respective members.

Figure 5:
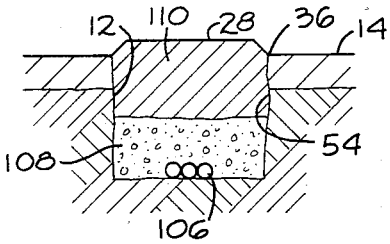
FIG. 5 is a vertical sectional view of the trench of FIG. 1 after it has been filled with paving material and prior to final compaction by a roller.

The side walls 24 are provided with lower horizontal flanges 70 for engagement with the paved surface 14. In addition, angular obstructions 72 can be attached to the inner surfaces of the side walls to form a trapezoidal mound of paving material over the trench, as illustrated in FIG. 5. The angular obstructions 72 are optional and produce a profile of material which is readily compacted into the trench with very little spillover. However, it is generally possible to force the majority of the mound material into the trench whether or not the mound is trapezoidal in cross-section.

The upper edge of the rear opening 26 is defined by a rear gate 74 extending downwardly beyond the end of the surface 22. The gate 74 is mounted for sliding movement within a pair of opposed slots 76 and is adjustable vertically by a screw thread mechanism 78. The height of the rear opening is thus variable by the screw thread mechanism to cause the portion 28 of paving material to extend a preselected distance above the paved surface. The distance is selected to achieve optimal compaction of the paving material in a particular set of circumstances and for a particular trench depth.

Figure 7:
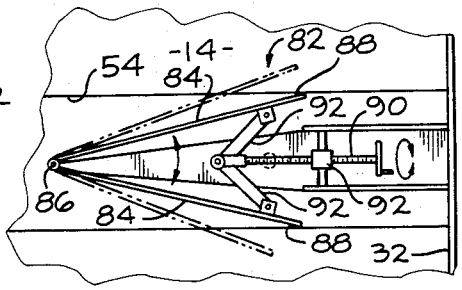
FIG. 7 is a top plan view of the guide mechanism of FIG. 1, taken in the direction 7—7 of FIG. 1.

The apparatus 10 is mounted for sliding movement along the paved surface 14 by a pair of skids 80 carried beneath the lower housing 32 and engaging the paved surface at opposite sides of the trench. The apparatus 10 is guided in this condition by a mechanism 82 which extends forwardly of the housing 32 to engage the inner walls 54 of the trench. As seen most clearly in FIG. 7, the guide mechanism 82 comprises a pair of splayed guide members 84 extending generally rearwardly from a forward pivot axis 86 to engage the trench walls at remote ends 88 thereof. The remote ends are connected to one end of a screw element 90 by a pair of links 92 to form a scissor type adjustment structure. The screw element 90 engages a stationary nut 92 such that rotation of the screw element moves the guide members 84 between the full line and phantom line conditions of FIG. 7. The guide mechanism 82 is therefore adjustable to cause the remote ends 88 to engage the inner walls of the trench.

Although virtually any type of vehicle can be used to tow the apparatus 10, the preferred vehicle is a dump truck of the type shown at 16 in FIG. 1. Such a truck can be provided with a tow bar 94 extending downwardly from its bed and a tow chain 96 connected to the apparatus 10. Gravity causes the paving material to pass from the truck along a chute 98.

The apparatus 10 is also provided with an adjustable wheel mechanism 100 for transportation of the apparatus when not in use. The wheel mechanism 100 comprises a pair of wheels 102 on either side of the apparatus, the wheels being actuable downwardly against the paved surface by corresponding jack mechanisms 104. In use, the wheels 102 will be retracted upwardly from the paved surface in the condition of FIGS. 1 and 2.

It will be understood that the various portions of the trench 12 have not been drawn to scale in the drawings. When a television transmission cable 106 is to be buried within the trench 12, it is preferably dug to a total depth of approximately 18 inches. The cable or conduit is then laid at the bottom of the trench and the trench is backfilled with a concrete slurry material 108 to within approximately 3 inches of the top of the paved surface 14. The remaining 3 inches are then filled with asphalt or other suitable paving material 110 by the process of the present invention, leaving a portion 28 of paving material extending above the paved surface 14. The portion 28 will generally extend above the paved surface a distance on the order of 1 inch or less, permitting the material to be substantially completely compacted by a conventional pavement roller passed thereover. The result is a smooth patch coinciding with the height of the paved surface 14.

In operation, the apparatus 10 is thus passed along a trench in the condition of FIG. 1. As the apparatus moves, the paving material passes downwardly along the chute 98 to fill the hopper 18, the passage 38 and the portion of the trench 12 directly beneath the apparatus. The weight of the paving material forces the doors 30 downwardly and outwardly against the edges 36 of the trench, and the forward movement of the apparatus urges excess paving material inwardly and downwardly into the trench. The material which is not forced into the trench is "extruded" from the rear opening 26 to form the portion 28 extending above the paved surface. During this process, the unit 20 constantly vibrates the apparatus 10 and the paving material passed therethrough, causing the material to settle and become compacted as it is passed to the trench. In many cases the vibrational forces will be within a vertical plane, enhancing the compaction of the material by the sloped surface portion 22. When it is desired to adapt the apparatus 10 to a trench of different width or height, this is accomplished with the adjusting mechanisms of the apparatus 10. Specifically, the position of the side walls 24 can be adjusted using the screw mechanisms 64 and the bell cranks 56, while the width of the guide mechanism 82 can be adjusted with the screw element 90. The height of the extruded portion of paving material can be varied by the screw thread mechanism 78 of the gate 74.

It will be understood that although the discussion herein refers specifically to asphalt as the material used to fill trenches in paved surfaces, the apparatus and method of the present invention is applicable generally to any substantially granular paving material. Gravel and composite materials containing gravel are possible substitutes for asphalt in some situations.

It will further be understood that many of the features of the apparatus 10 are provided for convenience and versatility, and are not necessary to the intended operation of the device. Thus, the doors 30 need not be hinged relative to the housing 32, and the side walls 24, the gate 74 and the guide mechanism 82 need not be adjustable. Further, the apparatus 10 can be constructed to roll or otherwise engage the paved surface 14, rather than sliding along the skids 80.

From the above, it can be seen that there has been provided an apparatus and method of introducing a substantially granular paving material into a trench in a precompacted condition, yielding a smooth and long lasting patch of the trench.

What is claimed is:

1. Apparatus for filling a trench in an existing paved surface with precompacted asphalt paving material, comprising:

a primary structure movable along the trench in contact with the paved surface, including:

means for receiving loose asphalt paving material; and means for conducting the asphalt paving material from the receiving means to the trench as the primary structure moves;

the conducting means comprising a pair of side walls extending rearwardly along the paved surface and converging toward remote ends thereof to urge the paving material laterally toward the trench, and a rearwardly sloping upper surface portion spanning the two side walls to define an open bottomed flow chamber which terminates in a rear opening above the level of the paved surface, such that paving material is forced through the opening as the primary structure moves; and means for vibrating the primary structure as the paving material is conducted to the trench.

2. The apparatus recited in claim 1 wherein the vibrating means is constructed to produce vibrations substantially within a vertical plane and is coupled to the sloping surface portion to further urge the paving material downwardly into the trench.

3. The apparatus recited in claim 1 wherein the primary structure is engageable with the paved surface material at opposite sides of the trench for sliding movement thereon.

4. The apparatus recited in claim 1 which further comprises means for guiding the primary structure along the trench, said guiding means being disposed forwardly of the primary structure and comprising a projection engaging the interior of the trench as the primary structure moves.

5. The apparatus recited in claim 1 wherein the side walls are adjustable to vary the spacing between the remote ends thereof.

6. The apparatus recited in claim 5 wherein the conducting means further comprises means for varying the height of the rear opening above the level of the paved surface.

7. The apparatus recited in claim 6 wherein the height varying means comprises a gate member adjustable relative to the upper surface portion to restrict the rear opening.

8. The apparatus recited in claim 1 wherein the rear opening has an uppermost lateral dimension and a lowermost lateral dimension, the uppermost dimension being less than the lowermost dimension.

9. The apparatus recited in claim 1 wherein the conducting means further comprises a pair of angular elements carried at the interior of the side walls to partially obstruct the rear opening and give it a trapezoidal shape.

10. Apparatus for filling a trench in an existing paved surface with precompacted asphalt paving material, comprising:

a primary structure movable along the trench in contact with the paved surface, including:

hopper means for receiving loose asphalt paving material; and means for conducting the asphalt paving material from the hopper means to the trench as the primary structure moves;

the conducting means comprising:

a pair of side walls extending rearwardly along the paved surface and converging at remote ends thereof to urge the paving material laterally toward the trench, the sidewalls being adjustable to vary the spacing between the remote ends thereof;

an upper surface portion spanning the two side walls to define an open bottom flow chamber which terminates in a trapezoidal rear opening, the upper surface portion sloping downwardly to urge the paving material toward the trench and through the opening as the primary structure moves; and means for varying the height of the rear opening above the level of the paved surface; and means for vibrating the primary structure to compact and facilitate flow of the paving material as it is conducted into the trench.

11. Apparatus for filling a trench in an existing paved surface with precompacted asphalt paving material, comprising:

a primary structure movable along the trench in contact with the paved surface, including:

means for receiving loose asphalt paving material;

means for conducting the asphalt paving material from the receiving means to the trench as the primary structure moves;

the conducting means comprising a pair of side walls extending rearwardly along the paved surface, and a rearwardly sloping upper surface portion spanning the side walls to define an open bottomed flow chamber which terminates at a location higher than the paved surface to form a rear opening, such that the paving material is forced through the opening as the primary structure moves; and means for vibrating the conducting means to precompact the paving material as it is conducted into the trench, the vibrating means being coupled to and located above said means for urging the paving material downwardly into the trench; and means for guiding the priamry structure along the trench, said guiding means being disposed forwardly of the primary structure and comprising a projection engaging the interior of the trench as the primary structure moves, and said projection being substantially V-shaped within a horizontal plane and adjustable in width to coincide substantially with the width of the trench.

12. Apparatus for filling a trench in an existing paved surface with precompacted asphalt paving material, comprising:

a primary structure movable along the trench in contact with the paved surface, including:

means for receiving loose asphalt paving material; and means for conducting the asphalt paving material from the receiving means to the trench as the primary structure moves;

the conducting means comprising a pair of side walls extending rearwardly along the paved surface and a rearwardly sloping upper surface portion spanning the two side walls to define an open bottomed flow chamber which terminates in a rear opening above the level of the paved surface, such that paving material is forced through the opening as the primary structure moves; and means for vibrating the primary structure as the paving material is conducted to the trench.

13. A method of filling a trench in an existing paved surface with precompacted asphalt paving material, comprising:

moving a container of loose asphalt paving material along the trench;

conducting the asphalt paving material from the container and toward the trench as the container moves;

drawing a rearwardly sloped surface along the paving material as the container moves, to urge the paving material downwardly into the trench;

extruding a quantity of paving material over the trench to a preselected height above the level of the paved surface; and vibrating the sloped surface and the paving material as the paving material is conducted into the trench.

14. The method recited in claim 13 which still further comprises the step of subsequently rolling the extruded material to compact it into the trench.

* * * * *

UNITED STATES PATENT AND TRADEMARK OFFICE

CERTIFICATE OF CORRECTION

PATENT NO. : 4,507,012

DATED : March 26, 1985

INVENTOR(S) : John J. Corcoran, and
John P. Fraijo

It is certified that error appears in the above-identified patent and that said Letters Patent are hereby corrected as shown below:

Column 8, line 12, "priamry" should be --primary--

Signed and Sealed this

First Day of October 1985

[SEAL]

Attest:

DONALD J. QUIGG

Attesting Officer

Commissioner of Patents and Trademarks—Designate